US008858285B1

(12) United States Patent
Wheatley

(10) Patent No.: US 8,858,285 B1
(45) Date of Patent: Oct. 14, 2014

(54) LIFE STREAMER SYSTEM

(71) Applicant: Darryl J. Wheatley, St. Petersburg, FL (US)

(72) Inventor: Darryl J. Wheatley, St. Petersburg, FL (US)

( * ) Notice: Subject to any disclaimer, the term of this patent is extended or adjusted under 35 U.S.C. 154(b) by 110 days.

(21) Appl. No.: 13/689,013

(22) Filed: Nov. 29, 2012

(51) Int. Cl.
*B63C 9/26* (2006.01)
*B63C 9/20* (2006.01)

(52) U.S. Cl.
CPC ..... *B63C 9/20* (2013.01)
USPC ..... 441/84

(58) Field of Classification Search
USPC ..... 441/80, 84; 116/209
IPC ..... B63C 9/26; G09F 17/00
See application file for complete search history.

(56) References Cited

U.S. PATENT DOCUMENTS

| | | | | |
|---|---|---|---|---|
| 4,474,349 | A * | 10/1984 | Loeckle | 244/136 |
| 5,421,287 | A * | 6/1995 | Yonover | 116/209 |
| 6,505,575 | B1 * | 1/2003 | Ciari | 116/209 |
| 7,695,334 | B2 * | 4/2010 | Yonover et al. | 441/36 |
| 2008/0254693 | A1 * | 10/2008 | Zogg | 441/84 |

* cited by examiner

*Primary Examiner* — Stephen Avila

(57) ABSTRACT

A generally rectilinear buoyant life preserver has a head hole and an upper section constituting a reception area above the head hole. A box-like pouch is coupled to the reception area. The pouch has an open front with a chamber created within the pouch. A buoyant cover is adapted to be coupled to and uncoupled from the pouch to close and open the chamber. A streamer fabricated of a flexible plastic sheet material has an inner end attached to the pouch and an outer end attached to the cover.

5 Claims, 3 Drawing Sheets

FIG. 5
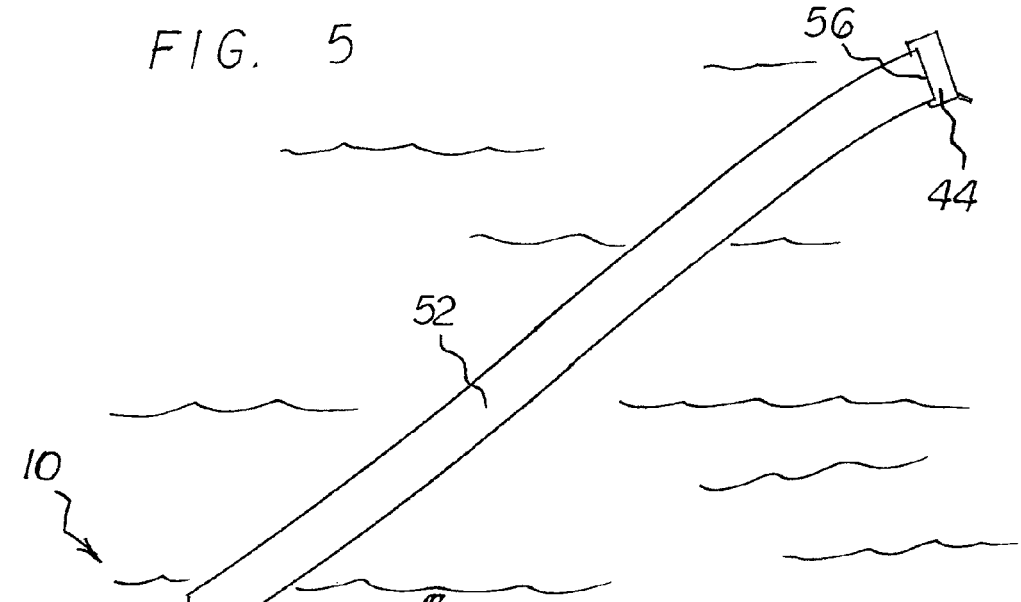
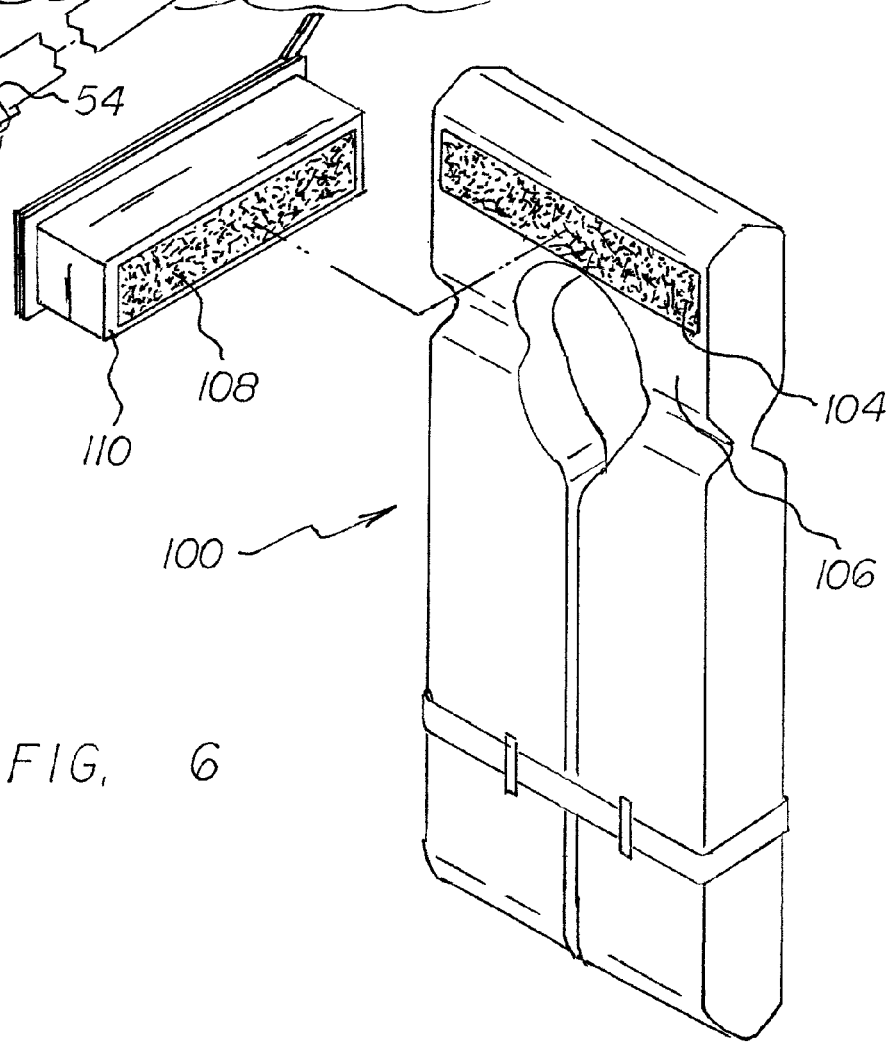
FIG. 6

LIFE STREAMER SYSTEM

BACKGROUND OF THE INVENTION

1. Field of the Invention

The present invention relates to a life streamer system and more particularly pertains to providing buoyancy to a survivor in the water while rendering such buoyed survivor readily visible from great distances, the rendering visible and the providing buoyancy being done in a safe, reliable, convenient and economical manner.

2. Description of the Prior Art

The use of life preserver systems of known designs and configurations is known in the prior art. More specifically, life preserver systems of known designs and configurations previously devised and utilized for the purpose of providing buoyancy of a survivor in the water are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned devices do not describe a life streamer system that allows for providing buoyancy to a survivor in the water while rendering such buoyed survivor readily visible from great distances, the rendering visible and the providing buoyancy being done in a safe, reliable, convenient and economical manner.

In this respect, the life streamer system according to the present invention substantially departs from the conventional concepts and designs of the prior art, and in doing so provides an apparatus primarily developed for the purpose of providing buoyancy to a survivor in the water while rendering such buoyed survivor readily visible from great distances, the rendering visible and the providing buoyancy being done in a safe, reliable, convenient and economical manner.

Therefore, it can be appreciated that there exists a continuing need for a new and improved life streamer system which can be used for providing buoyancy to a survivor in the water while rendering such buoyed survivor readily visible from great distances, the rendering visible and the providing buoyancy being done in a safe, reliable, convenient and economical manner. In this regard, the present invention substantially fulfills this need.

SUMMARY OF THE INVENTION

In view of the foregoing disadvantages inherent in the known types of life preserver systems of known designs and configurations now present in the prior art, the present invention provides an improved life streamer system. As such, the general purpose of the present invention, which will be described subsequently in greater detail, is to provide a new and improved life streamer system and method which has all the advantages of the prior art and none of the disadvantages.

To attain this, the present invention essentially comprises a generally rectilinear buoyant life preserver having a head hole and an upper section which constitutes a reception area above the head hole. A box-like pouch is coupled to the reception area. The pouch has an open front with a chamber created within the pouch. A buoyant cover is adapted to be coupled to and uncoupled from the pouch to close and open the chamber. A streamer fabricated of a flexible plastic sheet material has an inner end attached to the pouch and an outer end attached to the cover.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved life streamer system which has all of the advantages of the prior art life preserver systems of known designs and configurations and none of the disadvantages.

It is another object of the present invention to provide a new and improved life streamer system which may be easily and efficiently manufactured and marketed.

It is further object of the present invention to provide a new and improved life streamer system which is of durable and reliable constructions.

An even further object of the present invention is to provide a new and improved life streamer system which is susceptible of a low cost of manufacture with regard to both materials and labor, and which accordingly is then susceptible of low prices of sale to the consuming public, thereby making such life streamer system economically available to the buying public.

Lastly, it is an object of the present invention is to provide a life streamer system for providing buoyancy to a survivor in the water while rendering such buoyed survivor readily visible from great distances, the rendering visible and the providing buoyancy being done in a safe, reliable, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of the system in the water after being deployed.

FIG. 6 is an exploded perspective illustration of an alternate embodiment of the invention.

The same reference numerals refer to the same parts throughout the various Figures.

DESCRIPTION OF THE PREFERRED EMBODIMENT

Figure 1:
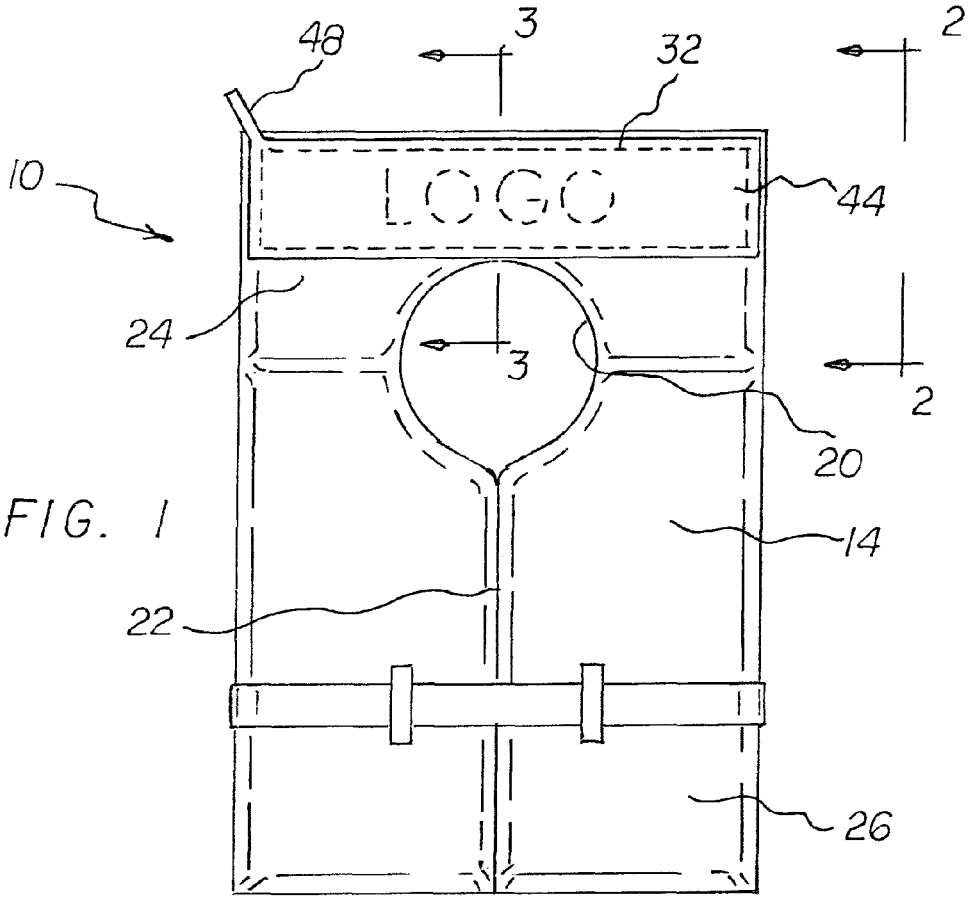
FIG. 1 is a front elevational view of a life streamer system constructed in accordance with the principles of the present invention.
Figure 2:
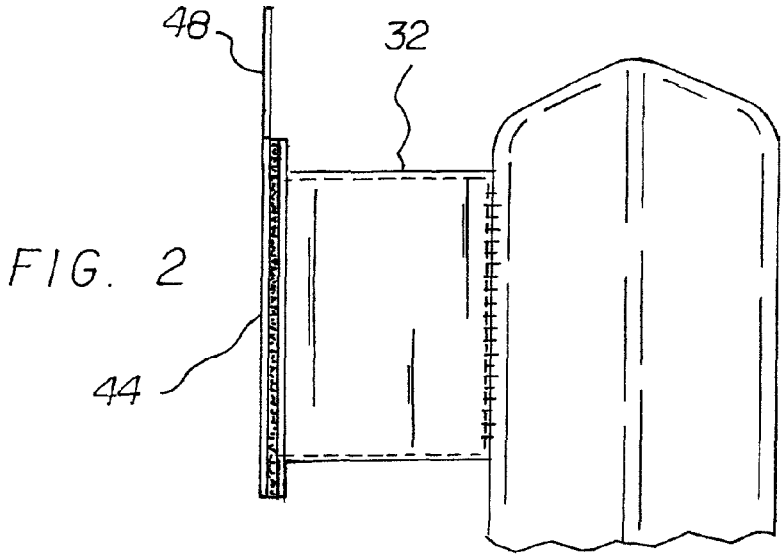
FIG. 2 is a side elevational view taken along line 2-2 of FIG. 1.
Figure 3:
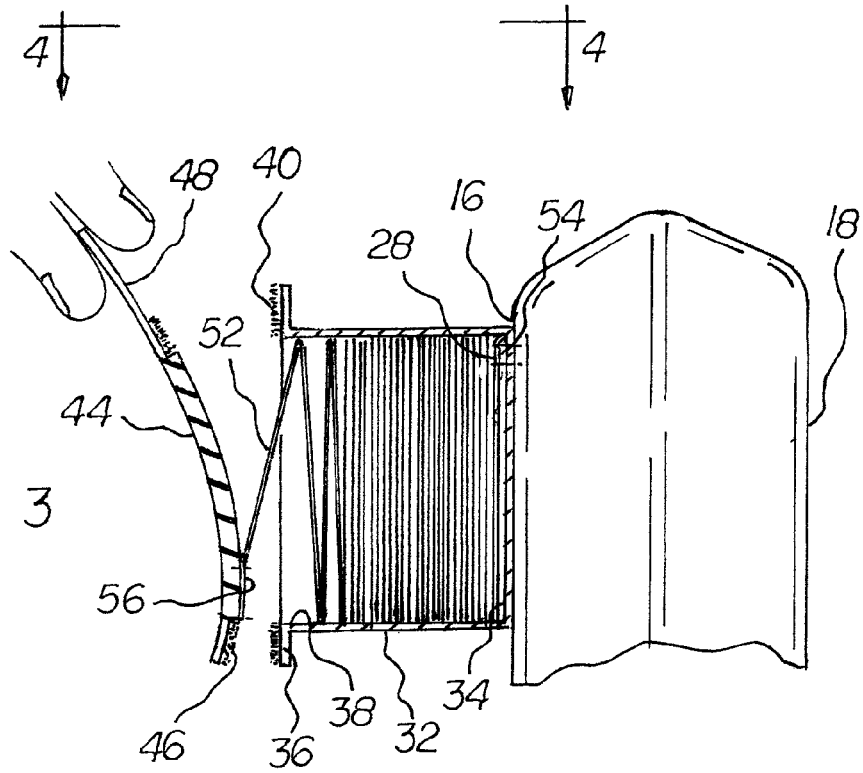
FIG. 3 is a cross sectional view taken along line 3-3 of FIG. 1.
Figure 4:
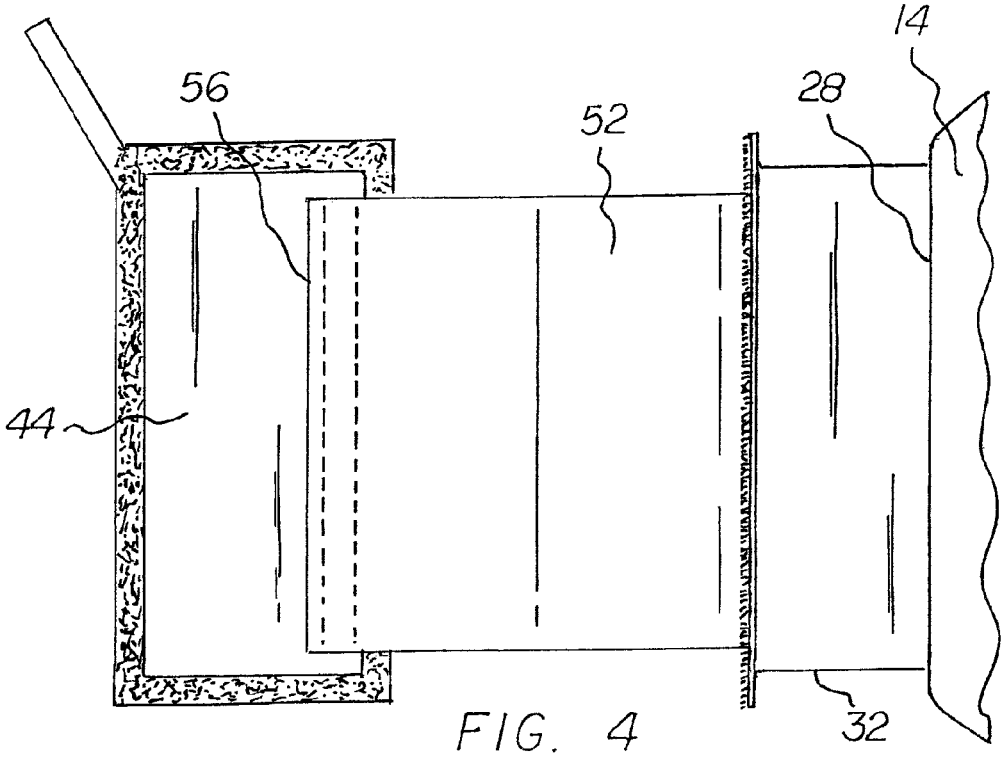
FIG. 4 is a plan view taken along line 4-4 of FIG. 3.

With reference now to the drawings, and in particular to FIG. 1 thereof, the preferred embodiment of the new and improved life streamer system embodying the principles and concepts of the present invention and generally designated by the reference numeral 10 will be described.

The present invention, the life streamer system 10 is comprised of a plurality of components. Such components in their broadest context include a buoyant life preserver, a pouch, a buoyant cover and a streamer. Such components are individually configured and correlated with respect to each other so as to attain the desired objective.

The life streamer system 10 of the present invention is for providing buoyancy to a survivor in the water while rendering such buoyed survivor readily visible from great distances. The rendering visible and the providing buoyancy are done in a safe, reliable, convenient and economical manner.

First provided is a life preserver 14 having a generally rectilinear configuration with an upper edge and a parallel lower edge separated by a height. The life preserver has a first side edge and a parallel second side edge separated by a width. The life preserver has a front face 16 and a rear face 18. The life preserver has a head hole 20. The life preserver has a slit 22 between the head hole and the lower edge midway between the first side edge and second side edge. The life preserver has an upper section 24 above the head hole and a lower section below the head hole. The life preserver also has a belt 26 encompassing a central elevation of the lower section. The upper section of the front face constitutes a reception area 28. The life preserver is fabricated of a buoyant material.

Next provided is a pouch 32 formed in a rectilinear box-like configuration. The pouch has a rear panel 34 stitched to the reception area of the life preserver. The pouch has a top panel and a bottom panel and side panels extending outwardly from the rear panel. The pouch has a rectangular open front with a peripheral flange 36. The pouch has a width of 12.5 inches, a height of 3 inches and a depth of 3.5 inches. A chamber 38 is created within the pouch between the rear, top, bottom and side panels and the open front. A fixed pile type fastener 40 is secured to the peripheral flange. The pouch is fabricated of a rigid plastic material.

A rectangular cover 44 is next provided. A separable pile type fastener 46 is peripherally secured to the cover. The separable pile type fastener of the cover is adapted to be coupled to and uncoupled from the fixed pile type fastener of the pouch to thereby close and open the chamber. The cover is fabricated of a buoyant plastic material with limited flexibility. A rip strap 48 is formed with the cover to facilitate removal of the cover from the pouch.

Lastly, a streamer 52 is provided. The streamer has an inner end 54 and an outer end 56. The inner end is attached to the bottom panel. The outer end is attached to the cover. The streamer is fabricated of a flexible plastic sheet material. The streamer has a length of 50 feet and a width of 12 inches. The streamer is a U.S. Coast Guard orange for increased visibility. The streamer has a stowed orientation folded in an accordion manner and located totally within the pouch with the cover coupled to the pouch through the fixed pile type fastener on the fixed pile type fastener. The streamer has a deployed orientation with the inner end within the pouch and the remainder of the streamer extended outside of the pouch for being readily viewed from great distances.

An alternate embodiment of the invention is illustrated in FIG. 6. In this embodiment, the system 100 includes a supplemental fixed pile type fastener 104 attached to the reception area of the life preserver 106. This embodiments also includes a supplemental removable pile type fastener 108 attached to the pouch 110. In this manner, existing life preservers may be readily upgraded. In this embodiment, the length of the streamer is from 25 to 75 times greater than the width.

The various embodiments of the present invention are capable of a wide variety of additional variations. For example, the pouch is capable of supporting added components such a a signaling mirror, or a water-proof flare or other safety or convenience components, such component adapted to be coupled, preferably removably coupled, to the pouch as through hook and loop fasteners.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A life streamer system comprising:

a life preserver having a front face and a rear face and a head hole, the life preserver having an upper section above the head hole and a lower section below the head hole, the upper section of the front face constituting a reception area located behind a head of a user;

a pouch formed in a box-like configuration coupled directly to the reception area of the life preserver, the pouch having an open front with a chamber created within the pouch;

a buoyant cover with a pile type fastener adapted to be coupled to and uncoupled from the pouch to thereby close and open the chamber; and a streamer having an inner end and an outer end, the inner end being attached to the pouch, the outer end being attached to the cover, the streamer being fabricated of a flexible plastic sheet material.

2. The system as set forth in claim 1 wherein the streamer has a length of 50 feet plus or minus 20 percent and a width of 12 inches plus or minus 20 percent.

3. The system as set forth in claim 1 wherein the pouch is permanently attached to the reception area.

4. The system (100) as set forth in claim 1 and further including a supplemental fixed pile type fastener (104)

attached to the reception area of the life preserver (106) and a supplemental removable pile type fastener (108) attached to the pouch (110) whereby existing life preservers may be readily upgraded, the streamer having a length and a width, the length being from 25 to 75 times greater than the width.

5. A life streamer system (10) for providing buoyancy to a survivor in the water while rendering such buoyed survivor readily visible from great distances, the rendering visible and the providing buoyancy being done in a safe, reliable, convenient and economical manner, the system comprising, in combination:

a life preserver (14) having a generally rectilinear configuration with an upper edge and a parallel lower edge separated by a height, the life preserver having a first side edge and a parallel second side edge separated by a width, the life preserver having a front face (16) and a rear face (18), the life preserver having a head hole (20), the life preserver having a slit (22) between the head hole and the lower edge midway between the first side edge and second side edge, the life preserver having an upper section (24) above the head hole and a lower section below the head hole, the life preserver also having a belt (26) encompassing a central elevation of the lower section, the upper section of the front face constituting a reception area (28), the life preserver being fabricated of a buoyant material;

a pouch (32) formed in a rectilinear box-like configuration with a rear panel (34) stitched to the reception area of the life preserver, the pouch having a top panel and a bottom panel and side panels extending outwardly from the rear panel, the pouch having a rectangular open front with a peripheral flange (36), the pouch having a width of 12.5 inches, a height of 3 inches and a depth of 3.5 inches, a chamber (38) created within the pouch between the rear, top, bottom and side panels and the open front, a fixed pile type fastener (40) secured to the peripheral flange, the pouch being fabricated of a rigid plastic material;

a rectangular cover (44), a separable pile type fastener (46) peripherally secured to the cover, the separable pile type fastener of the cover adapted to be coupled to and uncoupled from the fixed pile type fastener of the pouch to thereby close and open the chamber, the cover being fabricated of a buoyant plastic material with limited flexibility, a rip strap (48) formed with the cover to facilitate removal of the cover from the pouch; and a streamer (52) having an inner end (54) and an outer end (56), the inner end being attached to the bottom panel, the outer end being attached to the cover, the streamer being fabricated of a flexible plastic sheet material, the streamer having a length of 50 feet and a width of 12 inches, the streamer being a U.S. Coast Guard orange for increased visibility, the streamer having a stowed orientation folded in an accordion manner and located totally within the pouch with the cover coupled to the pouch through the fixed pile type fastener on the fixed pile type fastener, the streamer having a deployed orientation with the inner end within the pouch and the remainder of the streamer extended outside of the pouch for being readily viewed from great distances.

* * * * *